United States Patent [19]

Penar

[11] Patent Number: 4,702,452

[45] Date of Patent: Oct. 27, 1987

[54] SMOKE DETECTOR MOUNTING

[76] Inventor: Leonard Penar, 8507 S. Ada St., Chicago, Ill. 60620

[21] Appl. No.: 905,350

[22] Filed: Sep. 10, 1986

[51] Int. Cl.[4] ..... A47H 1/10

[52] U.S. Cl. ..... 248/317; 248/222.3; 248/223.2; 362/253; 340/628; 340/693

[58] Field of Search ..... 248/213.2, 222.3, 222.4, 248/223.2, 317, 318, 339, 342, 343, 344; 340/628-629, 630, 693; 362/253

[56] References Cited

U.S. PATENT DOCUMENTS

| | | | |
|---|---|---|---|
| 947,550 | 1/1910 | Ramsey | 248/317 |
| 1,095,504 | 5/1914 | Jannoch | 248/318 |
| 1,242,533 | 10/1917 | Duck . | |
| 1,489,175 | 4/1924 | Vandy . | |
| 1,639,125 | 8/1927 | Benjamin . | |
| 1,669,199 | 5/1928 | Hicks | 248/223.2 |
| 1,748,433 | 2/1930 | Wetzell | 248/222.3 |
| 2,330,942 | 10/1943 | Anderson . | |
| 3,137,763 | 6/1964 | Jones . | |
| 3,172,608 | 3/1965 | Ausman | 248/339 |
| 3,389,524 | 6/1968 | Weber | 248/317 |
| 3,676,570 | 7/1972 | Gabb . | |
| 4,090,178 | 5/1978 | Norris | 340/630 |
| 4,147,320 | 4/1979 | Biedebach | 248/318 |
| 4,257,039 | 3/1981 | Webb | 362/253 |
| 4,385,742 | 5/1983 | Rocquin | 248/318 |

*Primary Examiner*—J. Franklin Foss
*Assistant Examiner*—Robert A. Olson
*Attorney, Agent, or Firm*—Kinzer, Plyer, Dorn, McEachran & Jambor

[57] ABSTRACT

A method and apparatus for mounting a smoke detector to an existing ceiling fixture in a manner which preserves the surface of the ceiling. A plurality of attachment elements are connected to the smoke detector housing. A plurality of hangers are connected at one end to an attachment element and at the other end to a thumbscrew in the existing ceiling fixture. The hangers have a length sufficient to suspend the smoke detector beneath the fixture.

3 Claims, 3 Drawing Figures

Fig.1.
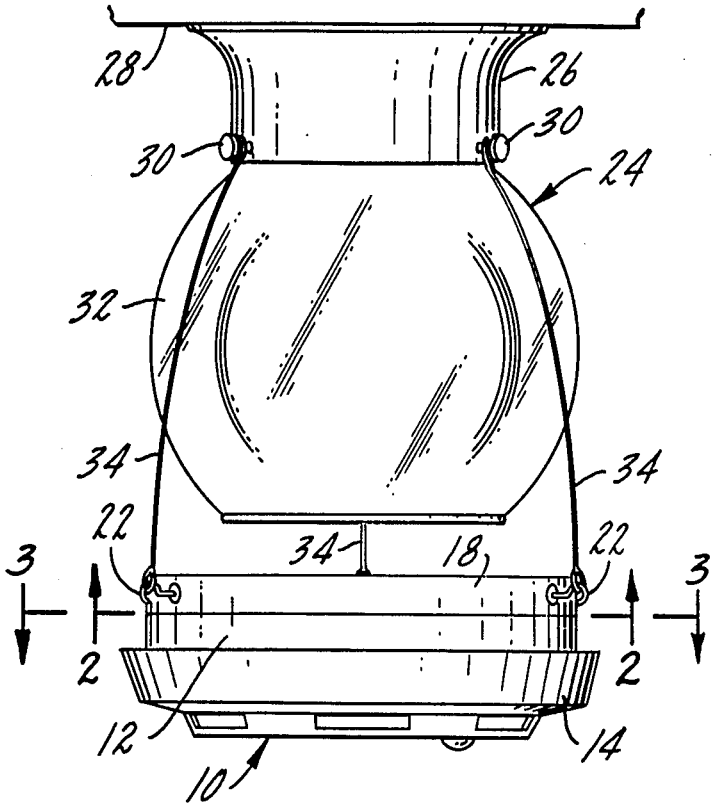
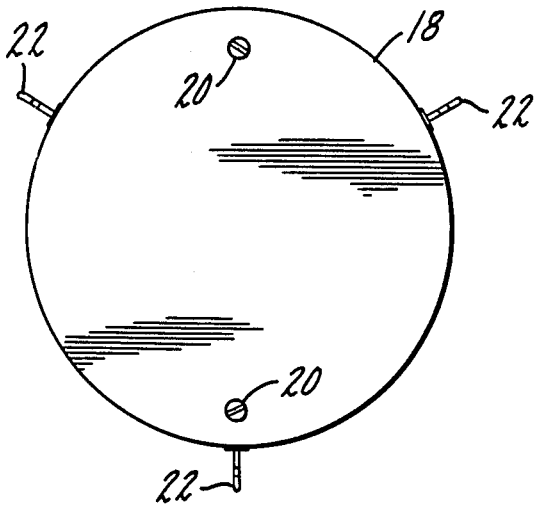
Fig.2.
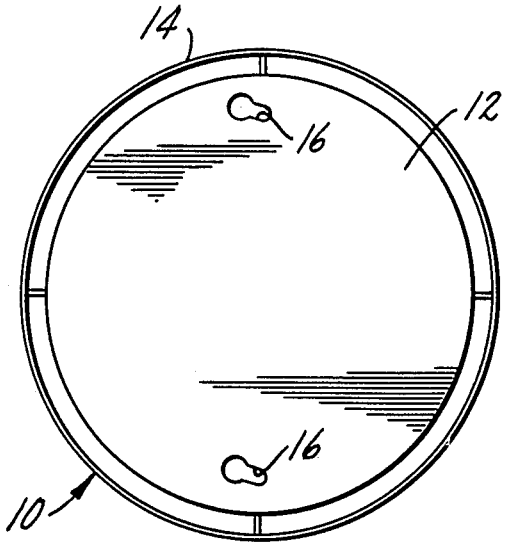
Fig.3.

SMOKE DETECTOR MOUNTING

SUMMARY OF THE INVENTION

Proper operation of smoke detectors requires that they be mounted at or near the ceiling of a room or hallway. This is typically done by drilling holes in the wall or ceiling for the admission of mounting screws. This mounting arrangement has several disadvantages. The holding power of screws in common ceiling materials, such as wallboard, is suspect. Commonly, plastic inserts are pushed into the holes to increase the holding power. This may or may not be satisfactory. Another disadvantage of drilling holes in ceilings is it mars the appearance of the ceiling and can lead to degradation of the surface. For example, cracks may result in a plaster surface or portions of the plaster may fall away when disturbed by the drilling operation.

The present invention is directed to a smoke detector mounting arrangement which avoids these problems and preserves the surface of a ceiling. The present invention accomplishes this by utilizing an existing ceiling fixture, typically a light fixture of the type having a plurality of thumbscrews. A plurality of hangers are connected to the thumbscrews and extend to a point below the light fixture where they are connected to the smoke detector to suspend it below the fixture. In this manner, the need to drill holes in a ceiling or wall is alleviated, and the consequent disadvantages of making holes are avoided.

BRIEF DESCRIPTION OF THE DRAWINGS

FIG. 1 is a side elevation view of a smoke detector mounted according to the present invention.

FIG. 2 is a bottom view of a mounting plate, taken along line 2—2 of FIG. 1.

FIG. 3 is a plan view of a smoke detector, taken along line 3—3 of FIG. 1.

DETAILED DESCRIPTION OF THE INVENTION

FIG. 1 illustrates the smoke detector mounting arrangement of the present invention. The smoke detector 10 includes a housing 12 and a cover 14. The base of the housing typically has two keyhole-shaped slots 16 formed therein. The enlarged portion of the slots 16 are sized to receive the head of a mounting screw. The smoke detector is then pushed to the side so that the shank of the mounting screw extends through the narrow portion of the slotd 16, entrapping the head underneath the narrowed portion and thereby retaining the smoke detector on the mounting screws. In the past, mounting screws have been fastened directly to a ceiling with the attendant disadvantages enumerated above. The present invention provides a wooden mounting plate 18 into which mounting screws 20 can be placed. These mounting screws fasten the smoke detector 10 to the mounting plate 18 in the traditional manner. A plurality of attachment elements in the form of hooks 22 are screwed into the sides of the mounting plate 18.

The smoke detector 10 is thus arranged to be connected to an existing ceiling fixture 24. The fixture includes a base 26 connected to the ceiling 28. A plurality of thumbscrews 30 screw into the base to retain a decorative globe or the like 32. A plurality of hangers 34 are connected at one end to the thumbscrews 30 and at the other end to the hooks 22. The hangers have a length sufficient to suspend the smoke detector 10 beneath the fixture 24. Preferably, the hangers 34 are made of wire which can be readily wound about the hooks and thumbscrews to provide the appropriate length for the hanger. Most typically, there are three thumbscrews in a fixture, so generally three attachment elements 22 will be provided. One hanger will then connect each thumbscrew to each attachment element.

While the illustrated embodiment shows the smoke detector connected to a mounting plate with hooks extending from the mounting plate, it will be understood that the mounting plate could be deleted if attachment means were provided in the housing 12 or the cover 14 of the smoke detector. The attachment element could take any form and could be as simple as a mere hole in the side of the housin or the cover through which hooks on the end of the hanger could extend. Thus, it will be understood that whereas a preferred form of the invention has been shown and described, the invention is to be limited only by the scope of the following claims.

I claim:

1. Apparatus for mounting a smoke detector to an existing ceiling fixture of the type having a plurality of thumbscrews, said apparatus comprising a smoke detector having a housing and cover with a pair of mounting slots in the housing, a mounting plate having a pair of mounting screws adapted for engagemen with the mounting slots to effect attachment of the smoke detector to the mounting plate, the mounting plate having an area large enough to cover the smoke detector housing, a plurality of attachment elements connected to the mounting plate, and a plurality of hangers, each connected at one end to an attachment element and connectable at the other end to a thumbscrew so as to suspend the mounting plate beneath said fixture.

2. The apparatus of claim 1 wherein the attachment elements are hooks.

3. The apparatus of claim 2 wherein the hangers are made of wire having one end wrapped around the hooks.

* * * * *